US005461752A

United States Patent [19]

Lemon et al.

[11] Patent Number: 5,461,752

[45] Date of Patent: Oct. 31, 1995

[54] PAINT TRAY ASSEMBLY, FOR MOUNTING ON EITHER ONE OF THE UPRIGHTS OF A LADDER

[76] Inventors: Francis W. Lemon, 67 First Avenue, Brockville, Ontario, Canada, K6V 3A9; Julian D. Lamb, 11 Halliday Street, Brockville, Ontario, Canada, K6V 3N8

[21] Appl. No.: 320,529

[22] Filed: Oct. 11, 1994

[51] Int. Cl.[6] ..... B44D 3/12

[52] U.S. Cl. ..... 15/257.06; 15/257.06; 248/238; 220/751; D32/53.1

[58] Field of Search ..... 15/257.05, 257.06; 182/129; 248/210, 211, 238; D32/53.1; 220/751

[56] References Cited

U.S. PATENT DOCUMENTS

| | | | |
|---|---|---|---|
| D. 347,306 | 5/1994 | Rogers et al. | D32/53.1 |
| 2,759,620 | 8/1956 | Pharris | 15/257.06 |
| 3,229,943 | 1/1966 | Olson | 182/129 |
| 3,822,846 | 7/1974 | Jesionowski | 15/257.06 |
| 3,940,824 | 3/1976 | Gioia et al. | 15/257.06 |
| 4,515,242 | 5/1985 | LaChance | 182/129 |
| 5,079,795 | 1/1992 | Schmid | 15/257.06 |

*Primary Examiner*—Mark Spisich
*Attorney, Agent, or Firm*—Francis W. Lemon

[57] ABSTRACT

A ladder-upright-mountable, paint tray assembly is provided wherein at least one bracket assembly is provided on the underside of upper, paint draining portion of the paint tray assembly. Therefor each bracket assembly is a sliding fit on the ladder upright and hooks over a portion of a ladder rung adjacent that upright. A central bracket assembly may be provided alone or in combination with two side bracket assemblies. In other embodiments only two side brackets are provided. Pairs of paint container wall members may also be provided, aligned with the bracket assemblies, for the ladder upright to be slidably retained therein.

6 Claims, 2 Drawing Sheets

PAINT TRAY ASSEMBLY, FOR MOUNTING ON EITHER ONE OF THE UPRIGHTS OF A LADDER

This invention relates to a paint tray assembly for mounting on either one of the uprights of a ladder.

BACKGROUND TO THE INVENTION

The conventional manner in which a paint tray is mounted on a ladder is to provide hooks on the underside of the tray so that the paint tray may be hooked over a ladder rung to be pivotally supported by that rung and lie against the rung immediately below, see, for example, U.S. Pat. No. 3,351,970, dated Nov. 14, 1967, H. A. Engh.

While the conventional hooks for supporting a paint tray on a ladder rung have been useful, this method of supporting a paint tray has presented a number of problems in that, i) a person on a ladder and using the paint tray is positioned more or less immediately beneath the paint tray and cannot avoid being in the path of paint dripping from a roller or brush that has been dipped into the tray, ii) a roller or brush that has been coated with paint from the paint tray has to be carried over a ladder upright to the side of the ladder before the paint can be applied to, say, a wall, during which time the chances of the paint dripping from the roller or brush are increased, iii) the tray is prone to dislodgement from the hanging position, and iv) no provision is made to restrain a lower portion of the tray against lateral movement relative to the ladder.

There is a need for a paint tray assembly that may be supported on a ladder in much a manner that, i) a person on a ladder is not immediately beneath the paint tray ii) a roller or brush that has been coated with paint does not have to be carried over a ladder upright, iii) the paint tray assembly will not be dislodged from the ladder by being pushed upwardly, and iv) provision is made to restrain a lower portion of the tray.

SUMMARY OF THE INVENTION

According to the present invention there is provided a paint tray assembly, for mounting on either one of the uprights of a ladder, comprising, a) an upper, inclined, paint draining portion which is downwardly inclined when the assembly is mounted on a ladder upright, b) a lower, open-topped paint container portion integral with the draining portion and for having a paint applicator dipped therein, and c) mounting means for removably mounting the paint tray assembly on a ladder upright in a slidable manner therealong, while restraining the upper and lower portions against lateral movement relative to that upright, the mounting means, in operation, supporting the upper and lower portion in a downwardly inclined position by hooking over a ladder rung.

The mounting means may comprise a bracket assembly on an underside of the draining portion, the bracket assembly being located centrally on the underside of the draining portion for centrally mounting the tray assembly centrally, between opposite lateral side portions thereof, over either one of the uprights of a ladder while locating on a portion of a ladder rung adjacent to that upright.

The bracket assembly may comprise two draining portion walled members, forming a channel, on the underside of the draining portion, for receiving the ladder upright therein in the slidable manner, and each draining portion walled member is recessed to hook over the ladder rung.

The bracket assembly may further comprise two paint container wall members on the underside of the paint container and aligned with the draining portion wall members for receiving, in a slidable manner, a ladder upright positioned between the draining portion wall members.

When the mounting means comprises a bracket assembly in the form of the two draining portion walled members located centrally on the underside of the draining portion, the mounting means may further comprise two side brackets on the underside of the draining portion and adjacent the respective lateral side portions thereof, the side brackets being spaced from one another with the bracket assembly therebetween and being for hooking on a portion of the ladder rung upon which the bracket assembly is hooked to support the tray assembly therewith.

The mounting means may further comprise two side bracket assemblies on the underside of the draining portion, the side bracket assemblies being spaced from one another and similar to the central bracket assembly, which is disposed between them so that the tray assembly can be supported on a ladder upright by a side bracket assembly.

The mounting means may further comprise, a) two side bracket assemblies on the underside of the draining portion, the side bracket assemblies being spaced from one another and similar to the central bracket assembly, which is disposed therebetween so that the tray assembly can also be supported on a ladder rung by a side bracket assembly, and b) two pairs of paint container wall members on the underside of the paint container and aligned with the side bracket assemblies for receiving therewith, in a slidable manner, a ladder upright.

BRIEF DESCRIPTION OF THE DRAWINGS

In the accompanying drawings which illustrate, by way of example, embodiments of the present invention.

DESCRIPTION OF THE PREFERRED EMBODIMENTS

Figure 1:
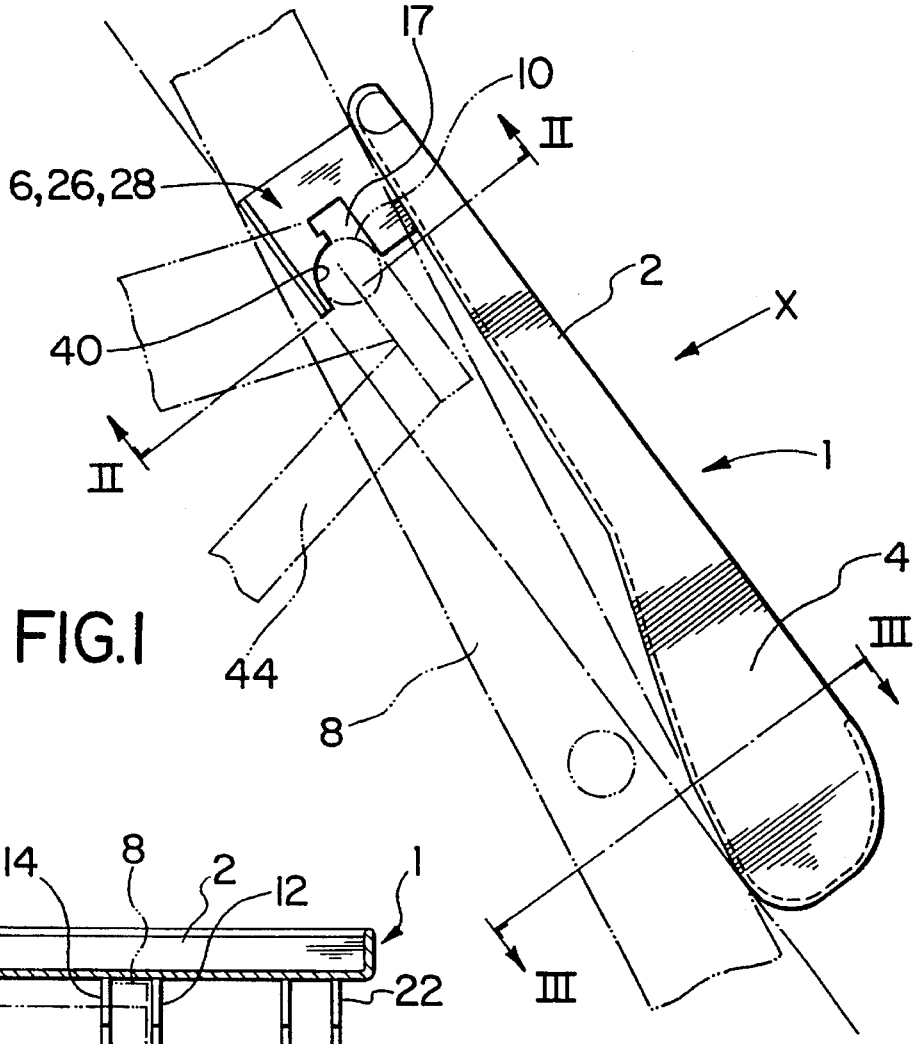
FIG. 1 is a side view of a paint tray assembly.

Referring to FIGS. 1–4, there is shown a paint tray assembly, for mounting on either one of the uprights of a ladder, generally designated 1, comprising, a) an upper, downwardly inclined, paint draining portion 2, which is downwardly inclined when the assembly 1 is mounted on a ladder upright, b) a lower, open-topped paint container portion 4 integral with the draining portion 2 and for having a paint applicator (not shown) dipped therein, and c) mounting means generally designated 6, for removably mounting the paint tray assembly 1 on a ladder upright, shown chain-dotted and designated 8, in a slidable manner therealong, while restraining the upper and lower portions, 2 and 4 respectively, against lateral movement relative to that upright 8, the mounting means 6, in operation, supporting the upper and lower portions, 2 and 4 respectively, in a downwardly inclined position by looking over a ladder rung, also shown chain-dotted and designated 10.

Figure 2:
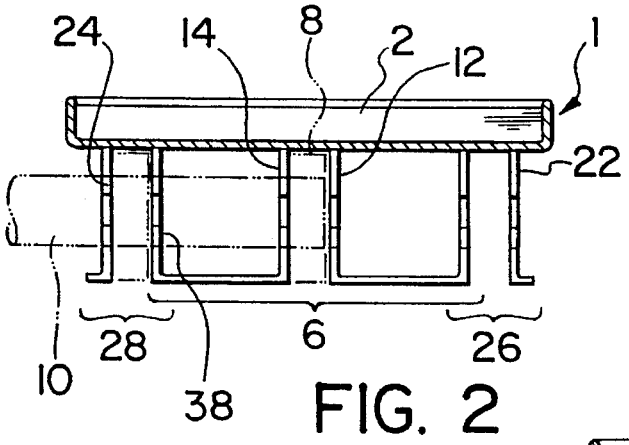
FIG. 2 is a sectional end view along II—II, FIG. 1.

As shown in FIG. 2, the mounting means 6 comprises a bracket assembly on an underside of the draining portion 2, the bracket assembly 6 being located centrally on the underside of the draining portion 2 for mounting the tray assembly 1 centrally, between opposite lateral side portions thereof, over either one of the uprights of a ladder, one being shown and designated 8 as in FIG. 1, while locating on a portion of a ladder rung 10 adjacent to that upright 8.

The bracket assembly comprises two draining portion walled members, designated 12 and 14, forming a channel 16 on the underside of the draining portion 2, for receiving the ladder upright 8 therein in the slidable manner, and each draining portion walled member 12 and 14 is recessed with a recess 17 (FIG. 1) to hook over the ladder rung 10.

In this embodiment, the bracket assembly 6 further comprises two paint container wall members 18 and 20 (FIG. 3) on an underside of the paint container 4 and aligned with the draining portion wall members, 12 and 14 respectively, for receiving, in a slidable manner, the ladder upright 8 positioned between the draining portion wall members 12 and 14.

As shown in FIG. 2, the mounting means further comprise two side brackets 22 and 24 on the underside of the draining portion 2 and adjacent the respective lateral side portions thereof, the brackets 22 and 24 being spaced from one another with the bracket assembly 6 therebetween and being for hooking on a portion of the ladder rung 10 upon which the bracket assembly 6 is hooked to support the tray assembly 1 therewith.

Figure 3:
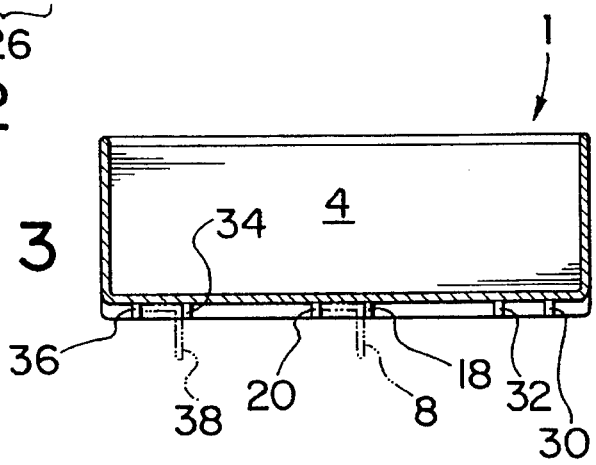
FIG. 3 is a sectional end view along III—III, FIG. 1.
Figure 4:
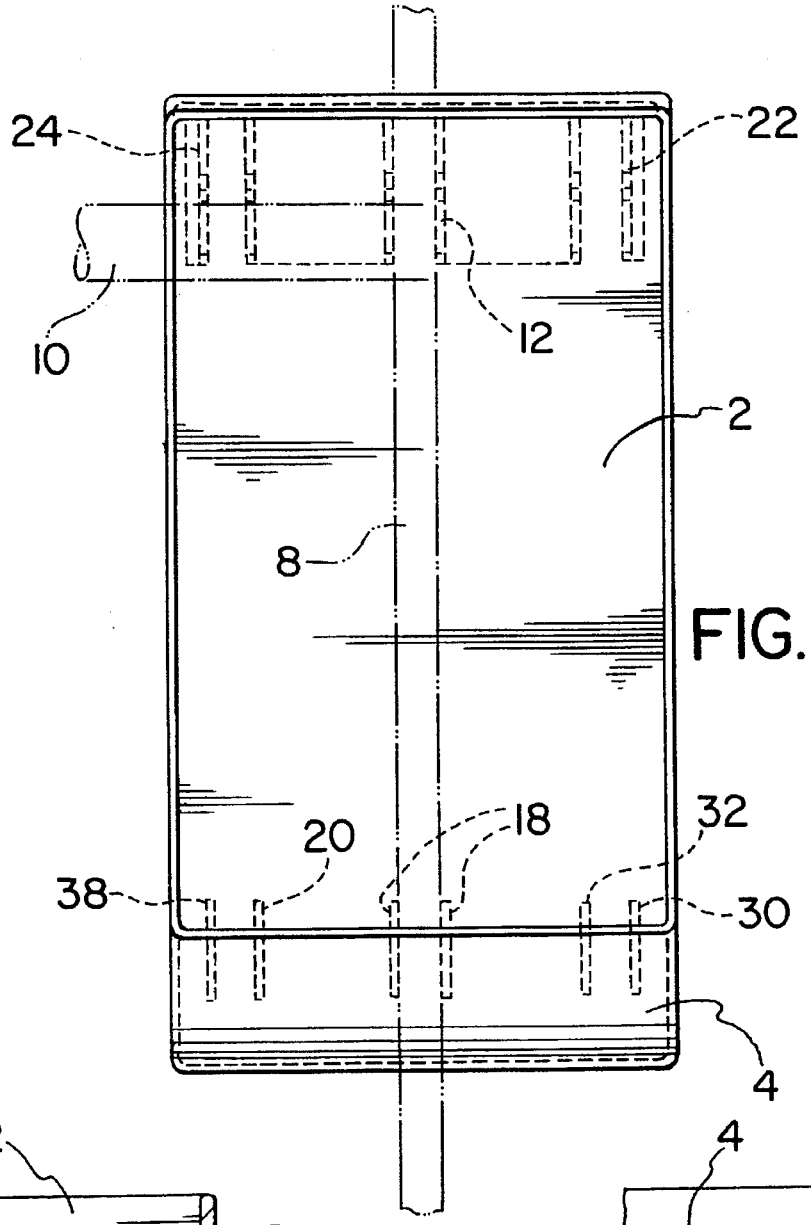
FIG. 4 is a plan view in the direction of arrow X, FIG. 1.

As will be seen in FIG. 3, the bracket assembly 6 forms a central bracket assembly 6, and, together with the side brackets 22 and 24, forms two side bracket assemblies, 26 and 28 respectively, on the underside of the draining portion 2. The side bracket assemblies 26 and 28 are spaced from one another and similar to the central bracket assembly 6, which is disposed therebetween so that the tray assembly 1 can be supported on a ladder upright by a side bracket assembly 26 or 28.

As shown in FIG. 3, the mounting means may further comprise two pairs of paint container wall members 30, 32 and 34, 36 on the underside of the paint container 4 and aligned with the side bracket assemblies 26 and 28 respectively for receiving therewith, in a slidable manner, a ladder upright, such as that shown chain-dotted and designated 38 (FIGS. 2 and 3).

As shown in FIG. 1, each bracket assembly 6, 26 and 28 is C-shaped in side view to provide the recess 17, a lower curved portion 40 of which hooks over the ladder rung 10. A notch is provided to receive a lip of the upper horizontal of a step ladder 44 so that the assembly 1 can be hooked over the horizontal and supported in the horizontally extending position YY.

The bracket assemblies 6, 26 and 28, and the paint container wall members 18, 20, 30, 32, 34 and 36 have aligned lower surfaces so that the paint tray assembly 1 may be used on a flat, horizontal surface extending along YY.

Figure 5:
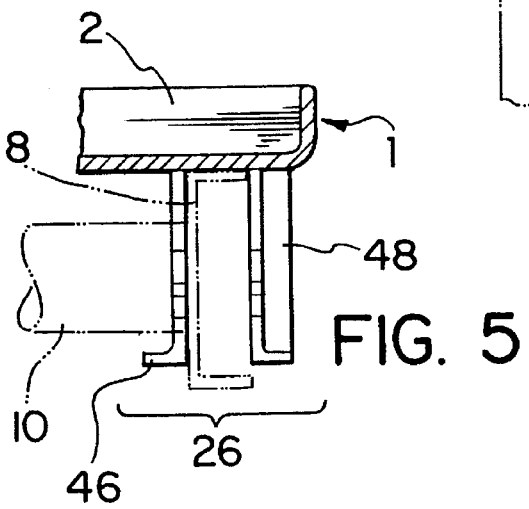
FIG. 5 is a scrap, sectional end view along V–V, FIG. 4, but of a different embodiment thereto.
Figure 6:
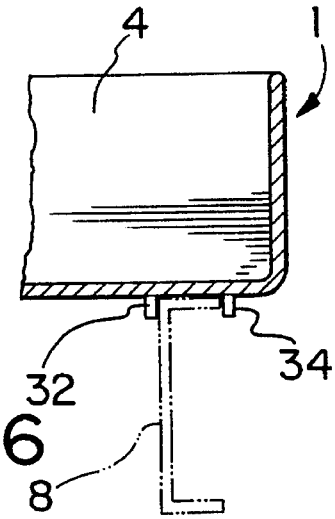
FIG. 6 is a scrap, sectional view along VI–VI, FIG. 4 of the embodiment show in FIG. 5.

In FIGS. 5 and 6, similar parts to those shown in FIGS. 1 to 4 are designated by the same reference numerals and the previous description is relied upon to describe them.

In FIGS. 5 and 6, only the bracket assemblies 26 and 28 are provided, and since in end view the bracket assembly 28 is a mirror image of the bracket assembly 26, a description of the bracket assembly 26 will suffice far both of them in that the bracket assembly 28 is the same as that shown in FIG. 2 but bracket assembly 6 is not provided for the bracket assembly 28 to be connected thereto.

In FIG. 5, the bracket assembly 26, instead of being connected to the bracket assembly 6, is provided with a flange 46. The bracket assembly 26 is provided with at least one stiffening rib 48.

As shown in FIG. 6, the paint container wall members 32 and may be provided on the paint container portion 4.

As will be seen from the drawings, the paint tray assembly 1, when inadvertently displaced upwardly, will slide upwardly along the ladder upright 8, and tend to fall back thereon, so that the tray assembly 1 will then slide down the ladder upright to the position from which it was displaced.

It will also be seen from the drawings that the tray assembly 1 will resist any tendency for it to be tilted and dislodged to hang by one side from a ladder rung.

It should be noted that, if desired, the paint tray assembly, may be hung from a ladder rung 10 in the conventional manner.

We claim

1. A paint tray assembly for mounting on either one of the uprights of a ladder, said paint tray assembly comprising, a) an upper, paint draining portion which is downwardly inlined when the assembly is mounted on a ladder upright, b) a lower, open-topped paint container portion integral with the draining portion and for having a paint applicator dipped therein, and c) mounting means for removably mounting the paint tray assembly on a ladder upright in a slidable manner therealong, while restraining the upper and lower portions against lateral movement relative to that upright, the mounting means, in operation, supporting the upper and lower portions in a downwardly inclined position by hooking over a ladder rung, the mounting means comprising a bracket assembly on an underside of the draining portion, the bracket assembly being located centrally on the underside of the draining portion between opposite lateral side portions thereof for mounting the tray assembly centrally over either one of the upright of a ladder while locating on a portion of a ladder rung adjacent to that uprights.

2. A tray assembly according to claim 1, wherein the bracket assembly comprises two draining portion walled members, forming a channel on the underside of the draining portion, for receiving the ladder upright therein in the slidable manner, and each draining portion walled member is recessed to hook over the adjacent ladder rung.

3. A tray assembly as claimed in claim 2, wherein the bracket assembly further comprises two paint container wall members on an underside of the paint container and aligned with the respective draining portion wall members for receiving, in a slidable manner, the ladder upright positioned between the draining portion wall members.

4. A tray assembly as claimed in claim 3, wherein the mounting means further comprises, a) two side bracket assemblies on the underside of the draining portion, the side bracket assemblies being spaced from one another and similar to the central bracket assembly, which is disposed therebetween so that the tray assembly can be supported on a ladder rung by a side bracket assembly, and b) two pairs of paint container wall members on an underside of the paint container and aligned with a respective one of the side bracket assemblies for receiving therewith, in a slidable manner, the ladder upright.

5. A tray assembly according to claim 2, wherein the mounting means further comprises two side bracket assemblies on the underside of the draining portion, the side bracket assemblies being spaced from one another and similar to the central bracket assembly, which is disposed therebetween so that the tray assembly can be supported on a ladder upright by a side bracket assembly.

6. A tray assembly according to claim 1, wherein the mounting means futher comprises two side brackets on the underside of the draining portion and adjacent the respective lateral side portions thereof, the side brackets being spaced from one another with the bracket assembly therebetween and being for hooking on a portion of the ladder rung upon which the bracket assembly is hooked to support the tray assembly therewith.

* * * * *